US008322486B2

(12) United States Patent
Ohta et al.

(10) Patent No.: US 8,322,486 B2
(45) Date of Patent: Dec. 4, 2012

(54) INTAKE SOUND GENERATION APPARATUS FOR INTERNAL COMBUSTION ENGINE

(75) Inventors: Katsuhisa Ohta, Kawagoe (JP); Junji Yoshida, Tokorozawa (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 0 days.

(21) Appl. No.: 13/165,290

(22) Filed: Jun. 21, 2011

(65) Prior Publication Data

US 2011/0315472 A1 Dec. 29, 2011

(30) Foreign Application Priority Data

Jun. 23, 2010 (JP) ..... 2010-142217

(51) Int. Cl.
*F02M 35/16* (2006.01)
*F02M 35/10* (2006.01)
*F01N 1/02* (2006.01)

(52) U.S. Cl. ..... 181/229; 181/250; 123/184.57

(58) Field of Classification Search ..... 181/229, 181/250, 175, 142, 160, 156, 271, 277, 278; 123/184.53, 184.57
See application file for complete search history.

(56) References Cited

U.S. PATENT DOCUMENTS

| | | | | |
|---|---|---|---|---|
| 2,458,043 | A * | 1/1949 | Zenner | 381/165 |
| 4,284,167 | A * | 8/1981 | Kozlow et al. | 181/172 |
| 4,547,631 | A * | 10/1985 | Nieuwendijk et al. | 381/161 |
| 4,577,495 | A * | 3/1986 | Bamer | 73/114.34 |
| 6,219,432 | B1 * | 4/2001 | Fryer et al. | 381/398 |
| 6,551,389 | B2 * | 4/2003 | Spannbauer et al. | 96/380 |
| 6,600,408 | B1 * | 7/2003 | Walter et al. | 340/384.1 |
| 6,634,457 | B2 * | 10/2003 | Paschereit et al. | 181/229 |
| 6,644,436 | B2 * | 11/2003 | Hofmann et al. | 181/214 |
| 6,848,410 | B2 * | 2/2005 | Hoffmann et al. | 123/184.57 |
| 7,188,703 | B2 * | 3/2007 | Hofmann et al. | 181/271 |
| 7,353,791 | B2 * | 4/2008 | Sasaki et al. | 123/184.57 |
| 7,448,353 | B2 * | 11/2008 | Shinada et al. | 123/184.57 |
| 7,464,788 | B2 * | 12/2008 | Alex et al. | 181/250 |
| 7,621,370 | B2 * | 11/2009 | Abe et al. | 181/204 |
| 7,658,263 | B2 * | 2/2010 | Jasnie et al. | 181/204 |
| 7,845,466 | B2 * | 12/2010 | Kostun et al. | 181/271 |
| RE42,490 | E * | 6/2011 | Takeuchi et al. | 181/271 |
| 7,975,802 | B2 * | 7/2011 | Yokoya et al. | 181/160 |
| 8,011,469 | B2 * | 9/2011 | Olson | 181/204 |
| 2002/0000343 | A1 | 1/2002 | Paschereit et al. | |
| 2005/0121255 | A1 * | 6/2005 | Hofmann et al. | 181/250 |
| 2005/0133300 | A1 * | 6/2005 | Hofmann et al. | 181/250 |
| 2006/0060419 | A1 * | 3/2006 | Alex et al. | 181/250 |
| 2007/0044747 | A1 * | 3/2007 | Sawatari et al. | 123/184.21 |
| 2009/0236171 | A1 | 9/2009 | Yokoya et al. | |
| 2010/0314193 | A1 * | 12/2010 | Jasnie | 181/175 |

FOREIGN PATENT DOCUMENTS

DE 19704376 A1 * 8/1998

(Continued)

*Primary Examiner* — Edgardo San Martin
(74) *Attorney, Agent, or Firm* — Foley & Lardner LLP

(57) ABSTRACT

An intake sound generation apparatus for an internal combustion engine, including an introduction duct connected to an intake passage of an intake system of the engine, a vibration member including a diaphragm portion which is vibrated by intake pulsation in the intake system, and a bellows portion configured to promote vibration of the diaphragm portion, the vibration member being so disposed as to cover one end of the introduction duct, and a resonance duct having one end connected to the introduction duct through the vibration member and the other end opened to an outside of the intake sound generation apparatus, the resonance duct acting to increase and emit a sound pressure of intake sound produced by vibration of the vibration member. A central axis of at least one of the introduction duct and the resonance duct is located offset relative to a central axis of the vibration member.

8 Claims, 7 Drawing Sheets

FOREIGN PATENT DOCUMENTS

| | | | | |
|---|---|---|---|---|
| DE | 10147059 | A1 | * | 4/2003 |
| EP | 1431536 | A1 | * | 6/2004 |
| EP | 1748420 | A2 | * | 1/2007 |
| EP | 2 103 801 | A2 | | 9/2009 |
| EP | 1 158 247 | A2 | | 11/2011 |
| JP | 58091328 | A | * | 5/1983 |
| JP | 2009-222011 | A | | 10/2009 |
| JP | 2009-270489 | A | | 11/2009 |

* cited by examiner

INTAKE SOUND GENERATION APPARATUS FOR INTERNAL COMBUSTION ENGINE

BACKGROUND OF THE INVENTION

The present invention relates to an intake sound generation apparatus which is adapted to positively generate an intake sound as a sound effect produced in association with an accelerator operation by using intake pulsations in an internal combustion engine.

Japanese Patent Application Unexamined Publication No. 2009-222011 and Japanese Patent Application Unexamined Publication No. 2009-270489 disclose such intake sound generation apparatus. In the intake sound generation apparatus of the conventional arts, a vibration member with bellows is vibrated (or resonated) using intake pulsations, and a sound pressure with a certain frequency range which is produced due to the vibration is increased by a resonance tube. This resonance effect provides such a sound quality that an intake sound with a sporty feeling or a powerful feeling can be produced as a sound effect in a vehicle compartment.

SUMMARY OF THE INVENTION

In the above-described conventional arts, a vibration member, and an introduction tube and a resonance tube which are disposed on both sides of the vibration member so as to sandwich the vibration member therebetween. The introduction tube and the resonance tube are disposed in axial alignment with a central axis of the vibration member, that is, the introduction tube, the resonance tube and the vibration member are arranged concentrically with each other. Due to this arrangement, an attitude (or a mode) of the vibration member is limited to only the specific direction. As a result, an intake sound generated as a sound effect has a resonance frequency in a relatively narrow band. Therefore, it is not possible to produce a sound effect corresponding to a wide range of a rotation speed of the engine which covers from a low rotation speed thereof to a high rotation speed thereof. There is a demand for improvement in producing the sound effect having a resonance frequency in a wide band.

The present invention has been made in view of the above-described problems in the techniques of the conventional arts. An object of the present invention is to provide an improved intake sound generation apparatus capable of generating an intake sound as a sound effect having a resonance frequency in a wider band.

In a first aspect of the present invention, there is provided an intake sound generation apparatus for an internal combustion engine, the internal combustion engine including an intake system including an intake passage, the intake sound generation apparatus including:

an introduction duct connected to the intake passage and introducing intake pulsation in the intake system thereinto;

a vibration member including a diaphragm portion which is vibrated by the intake pulsation, and a bellows portion configured to promote vibration of the diaphragm portion, the vibration member being so disposed as to cover one end of the introduction duct, and a resonance duct having one end connected to the introduction duct through the vibration member and the other end opened to an outside of the intake sound generation apparatus, the resonance duct acting to increase and emit a sound pressure of intake sound produced by vibration of the vibration member, wherein a central axis of at least one of the introduction duct and the resonance duct is located offset relative to a central axis of the vibration member.

In a second aspect of the present invention, there is provided the intake sound generation apparatus according to the first aspect, wherein the central axis of the introduction duct and the central axis of the resonance duct are located offset in directions opposite to each other with respect to the central axis of the vibration member.

In a third aspect of the present invention, there is provided the intake sound generation apparatus according to the first aspect, wherein an offset amount of the central axis of the at least one of the introduction duct and the resonance duct with respect to the central axis of the vibration member is set in a range of 7% to 40% of a diameter of the vibration member.

In a fourth aspect of the present invention, there is provided the intake sound generation apparatus according to the third aspect, wherein the vibration member has a generally cylindrical shape with a closed end, the diaphragm portion is formed by a bottom wall of the vibration member and the bellows portion is formed by a cylindrical side wall of the vibration member.

In a fifth aspect of the present invention, there is provided the intake sound generation apparatus according to the fourth aspect, further including a chamber which accommodates the vibration member, wherein the chamber has a diameter larger than a diameter of the introduction duct and a diameter of the resonance duct, and the introduction duct and the resonance duct are connected to opposite sides of the chamber in an axial direction of the chamber.

In a sixth aspect of the present invention, there is provided the intake sound generation apparatus according to the fifth aspect, wherein the chamber is disposed concentrically with the vibration member.

In a seventh aspect of the present invention, there is provided the intake sound generation apparatus according to the fifth aspect, wherein the diaphragm portion and the bellows portion of the vibration member are disposed without contact with the chamber.

In an eighth aspect of the present invention, there is provided the intake sound generation apparatus according to the fifth aspect, wherein the chamber is formed integrally with the resonance duct.

In a ninth aspect of the present invention, there is provided the intake sound generation apparatus according to the fifth aspect, wherein the vibration member is fixedly held between the introduction duct and the chamber.

In the intake sound generation apparatus according to the present invention, a central axis of at least one of the introduction duct and the resonance duct is located offset, that is, so-called eccentric, relative to a central axis of the vibration member. The vibration of the vibration member which is generated by intake pulsation in the intake system is a composite vibration of a vibration component in the axial direction of the vibration member and a vibration component in the radial direction of the vibration member which is determined based on the offset amount of the central axis of at least one of the introduction duct and the resonance duct. Accordingly, as compared to an intake sound generation apparatus in which a central axis of at least one of the introduction duct and the resonance duct is not offset relative to a central axis of the vibration member, the intake sound generation apparatus according to the embodiment and the modifications can produce an intake sound which is generated as a sound effect with a given sound quality added, in a wider frequency band.

DETAILED DESCRIPTION OF THE INVENTION

Figure 1:
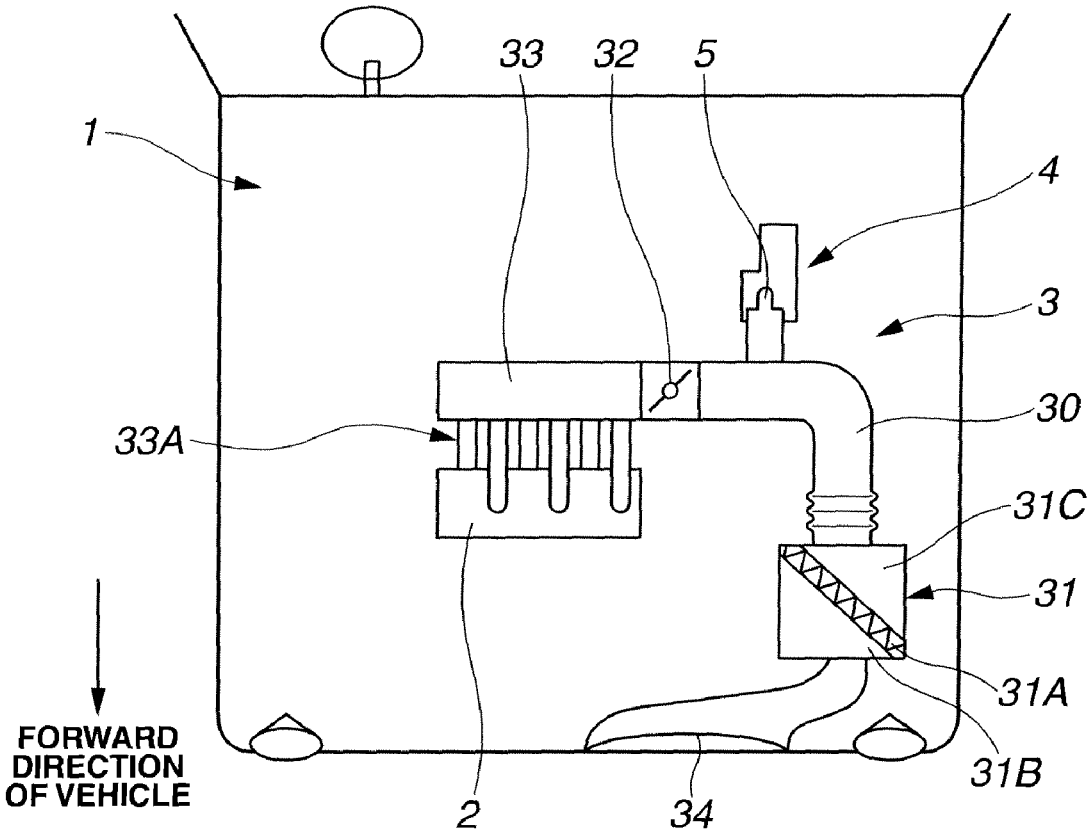
FIG. 1 is a schematic plan view of an engine compartment of a vehicle, to which an intake sound generation apparatus according to an embodiment of the present invention is applied.

Referring to FIG. 1, there is schematically shown an engine compartment of a vehicle to which an intake sound generation apparatus according to an embodiment of the present invention is applied.

As shown in FIG. 1, an engine as an internal combustion engine, for instance, a six-cylinder engine 2 is accommodated in an engine compartment 1. The engine 2 is provided with an intake system 3 which supplies air taken from an outside (i.e., an intake air) to respective cylinders of the engine 2. The intake system 3 includes an intake passage 30, an air cleaner 31, a throttle valve 32 and an intake manifold 33.

The intake passage 30 includes an intake opening 34 opened to a front side of the vehicle. Air is introduced from the intake opening 34 into the intake passage 30. The air cleaner 31 and the throttle valve 32 are successively arranged in the intake passage 30 in this order from an upstream side of the intake passage 30. The intake passage 30 is connected to the intake manifold 33 through the throttle valve 32.

The air cleaner 31 is divided into a dust side portion 31B and a clean side portion 31C by a filter element 31A. The filter element 31A of the air cleaner 31 serves to remove dust or dirt contained in the air introduced from the intake opening 34. The throttle valve 32 adjusts an amount of the intake air passing through the intake passage 30 by varying a sectional area of the intake passage 30 through which the intake air flows.

The intake manifold 33 includes a plurality of branch pipes 33A which are communicated with the cylinders of the engine 2, respectively. With this construction, the intake air which passes through the intake passage 30 and then flows into the intake manifold 33 is distributed into the respective cylinders of the engine 2 through branch pipes 33A.

In the thus constructed intake system 3, there occurs intake pulsation due to reciprocating movement of pistons and intake valves (both not shown) of the engine 2. In order to produce an intake sound with a given sound quality as a sound effect by utilizing the intake pulsation, an intake sound generation apparatus 4 is disposed in the intake passage 30 between the air cleaner 31 and the throttle valve 32. The intake sound generation apparatus 4 includes a vibration member (hereinafter also referred to as a sound piece) 5 and is constructed to vibrate the vibration member 5 by utilizing the intake pulsation as a vibration source, generate a distinctive intake sound with a given sound quality and transmit the intake sound as a sound effect into a compartment of the vehicle as explained later.

Figure 2:
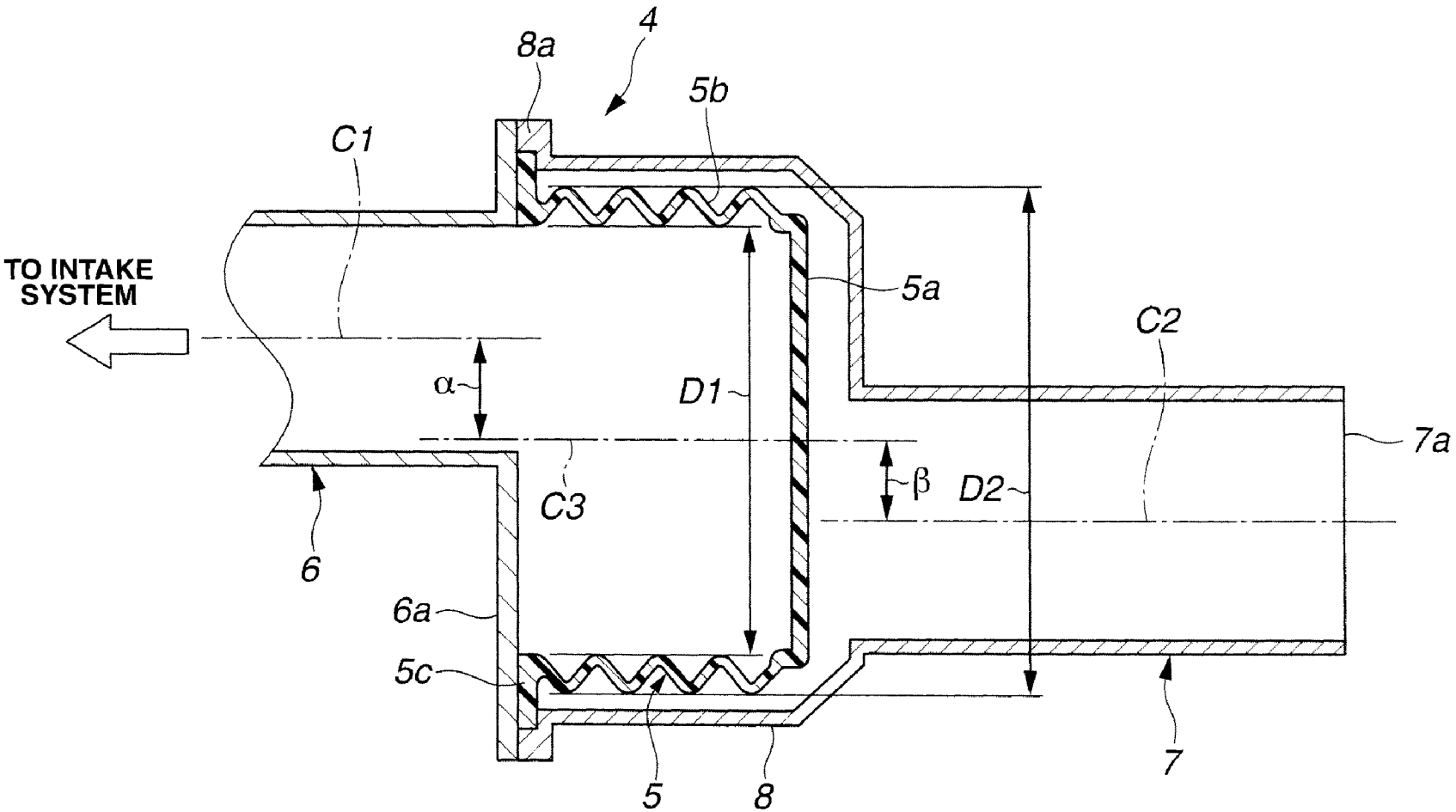
FIG. 2 is a sectional view of an essential part of the intake sound generation apparatus according to the embodiment of the present invention, taken along an axial direction of the intake sound generation apparatus.

Referring to FIG. 2, the intake sound generation apparatus 4 is explained in detail hereinafter. As shown in FIG. 2, the intake sound generation apparatus 4 includes the vibration member 5 which is vibrated by the intake pulsation as the vibration source, a cylindrical or pipe-shaped introduction duct 6 which serves as an introduction tube to introduce the intake pulsation in the intake passage 30, and a cylindrical or pipe-shaped resonance duct 7 which serves as a resonance tube to increase a sound pressure of an intake sound having a predetermined frequency band. Both the introduction duct 6 and the resonance duct 7 may be made of a resin material. In the intake sound generation apparatus 4, the introduction duct 6 and the resonance duct 7 are connected with each other, and the vibration member 5 is disposed between the introduction duct 6 and the resonance duct 7.

The introduction duct 6 has one end which is communicated and connected with the intake passage 30 between the air cleaner 31 and the throttle valve 32 as shown in FIG. 1. The other end of the introduction duct 6 is formed with a flange portion 6*a* through which the introduction duct 6 is connected with a cylindrical chamber 8 disposed on the side of the resonance duct 7 as explained later.

The vibration member 5 is fixed to the other end of the introduction duct 6 so as to cover an opening of the other end of the introduction duct 6, and is accommodated in an inside space of the chamber 8. The vibration member 5 is formed from a given resin material into a generally cylindrical or cup shape having a closed end. The vibration member 5 includes a flat diaphragm portion 5*a* having a predetermined thickness, a cylindrical bellows portion 5*b* having one end connected with the diaphragm portion 5*a*, and a flange portion 5*c* formed at a peripheral edge of the other end of the bellows portion 5*b*. The flange portion 5*c* abuts on the flange portion 6*a* of the introduction duct 6 so that the vibration member 5 is connected with the introduction duct 6. The diaphragm portion 5*a* forms a bottom wall of the vibration member 5, and the bellows portion 5*b* forms a cylindrical side wall of the vibration member 5. The diaphragm portion 5*a* is disposed perpendicular to a central axis C1 of the introduction duct 6 and is vibrated by the intake pulsation in the introduction duct 6 which serves as the vibration source. The bellows portion 5*b* has a wall thickness smaller than that of the diaphragm portion 5*a*, and is formed into a so-called bellows (accordion) shape so as to promote vibration of the diaphragm portion 5*a*.

In the thus constructed vibration member 5, the diaphragm portion 5*a* is vibrated due to a pressure change which is caused due to the intake pulsation in the introduction duct 6, so that a distinctive intake sound with a given sound quality resulting from the vibration of the diaphragm portion 5*a* is generated in the resonance duct 7.

The resonance duct 7 has a function of increasing a sound pressure of the intake sound in a predetermined frequency band (i.e., a frequency band of the order determined on the basis of the number of cylinders of the engine 2) by so-called columnar resonance and emitting the intake sound increased. The resonance duct 7 has an opening 7*a* at one end thereof which is opened to an outside of the resonance duct 7. The intake sound increased is emitted from the opening 7*a*. In consideration of the function of the resonance duct 7 per se, the resonance duct 7 is arranged such that the opening 7*a* is oriented toward a part of the vehicle, for instance, a dash panel which isolates and defines the engine compartment 1, so as not to insulate the intake sound to be emitted from the opening 7*a*.

Further, the chamber 8 is disposed at the other end of the resonance duct 7, and has a diameter (an inner diameter) larger than diameters (inner diameters) of the resonance duct 7 and the introduction duct 6. The chamber 8 is integrally formed with the resonance duct 7. The chamber 8 has a flange portion 8*a* at an open end thereof which is opened toward the introduction duct 6. The flange portion 8*a* is mated with the flange portion 6*a* of the introduction duct 6. The chamber 8 is connected with the introduction duct 6 by the mating abutment of the flange portion 8*a* and the flange portion 6*a*. The chamber 8 is disposed concentrically (coaxially) with the vibration member 5, and accommodates the vibration member 5 therein without contact with the diaphragm portion 5*a* and the bellows portion 5*b* of the vibration member 5.

Further, the flange portion 5*c* of the vibration member 5 is interposed between the flange portion 6*a* of the introduction duct 6 and the flange portion 8*a* of the chamber 8, and fixed thereto by welding. With this construction, the vibration member 5, the introduction duct 6 and the chamber 8 are formed as a one-piece, and the vibration member 5 is fixedly held between the introduction duct 6 and the chamber 8. In addition, a length and a diameter of the resonance duct 7 can be suitably adjusted to thereby increase a sound pressure of the intake sound in a target frequency band.

In the vehicle equipped with the thus constructed intake sound generation apparatus 4, the vibration member 5 accommodated in the chamber 8 is positively vibrated by utilizing the intake pulsation in the intake system 3, and the vibration member 5 and the chamber 8 are interacted with each other to generate the desired columnar resonance effect. Owing to this interaction between the vibration member 5 and the chamber 8, a distinctive intake sound with an additional sound quality can be generated, and a sound pressure of the intake sound can be increased by columnar resonance in the resonance duct 7. As a result, the increased intake sound which creates a sporty feeling or a powerful feeling can be generated as a sound effect in the vehicle compartment.

In the intake sound generation apparatus 4 according to this embodiment as shown in FIG. 2, the central axis C1 of the introduction duct 6 and the central axis C2 of the resonance duct 7 are located in an offset (or eccentric) relation to the common central axis C3 of the chamber 8 and the vibration member 5 accommodated in the chamber 8, by a predetermined amount $\alpha$ and a predetermined amount $\beta$, respectively. More specifically, the central axis C1 of the introduction duct 6 is located offset relative to the common central axis C3 of the vibration member 5 and the chamber 8 by the predetermined amount $\alpha$ in a radial direction of the vibration member 5, and the central axis C2 of the resonance duct 7 is located offset relative to the common central axis C3 of the vibration member 5 and the chamber 8 by the predetermined amount $\beta$ in a radial direction of the vibration member 5 diametrically opposed to the offset direction of the introduction duct 6. However, as long as the central axis C1 of the introduction duct 6 and the central axis C2 of the resonance duct 7 are located offset relative to the central axis C3, the central axis C1 and the central axis C2 are not required to be offset relative to the central axis C3 in diametrically opposed radial directions of the vibration member 5.

An offset (or eccentric) rate P1 of the introduction duct 6 and an offset (or eccentric) rate P2 of the resonance duct 7 with respect to the vibration member 5 are defined by the following expressions (1) and (2):

$$P1(\%)=\alpha/D1\times100 \quad (1)$$

wherein $\alpha$ indicates a predetermined amount of offset of the central axis C1 of the introduction duct 6 with respect to the central axis C3 of the vibration member 5, and D1 indicates an inner diameter of the vibration member 5.

$$P2(\%)=\alpha/D2\times100 \quad (2)$$

wherein $\beta$ indicates a predetermined amount of offset of the central axis C2 of the resonance duct 7 with respect to the central axis C3 of the vibration member 5, and D2 indicates an outer diameter of the vibration member 5.

The respective offset rates P1 and P2 are adjusted to lie within the range of 7% to 40%.

Figure 3:
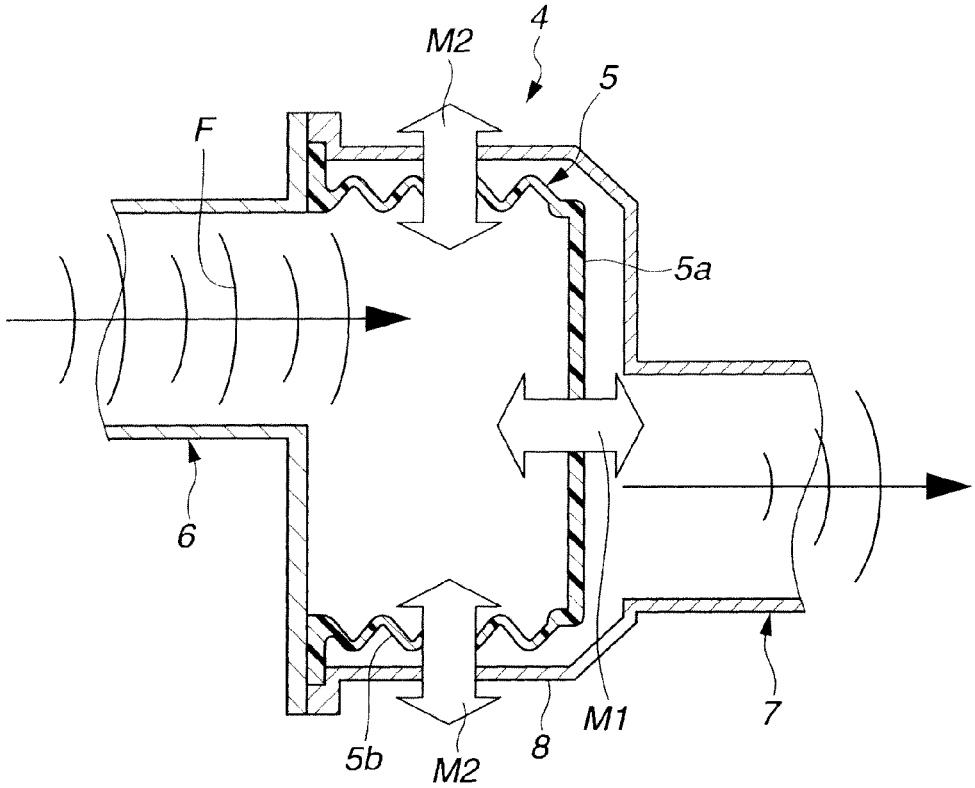
FIG. 3 is an explanatory diagram showing a function of the intake sound generation apparatus as shown in FIG. 2.

In the thus constructed intake sound generation apparatus 4, as shown in FIG. 3, the vibration member 5 is vibrated in an axial direction thereof as indicated by arrow M1 by intake pulsation F in the intake system 3 of the engine 2 which is inputted to the vibration member 5. That is, the diaphragm portion 5*a* of the vibration member 5 is vibrated with expansion displacement of the bellows portion 5*b*, thereby generating an intake sound. The intake sound generated from the introduction duct 6 undergoes interaction with columnar resonance in the vibration member 5 and the chamber 8, so that a distinctive intake sound with a given sound quality added to the intake sound is produced. Further, a sound pressure of the distinctive intake sound is increased in the resonance duct 7, and finally, the intake sound having the increased sound pressure is emitted from the opening 7*a* of the resonance duct 7 to the outside as explained above.

Figure 4A:
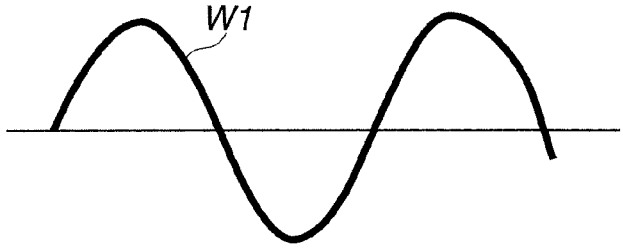
FIG. 4 is an explanatory diagram showing variation in vibration waveform which is provided on the basis of the function shown in FIG. 3.
Figure 4B:
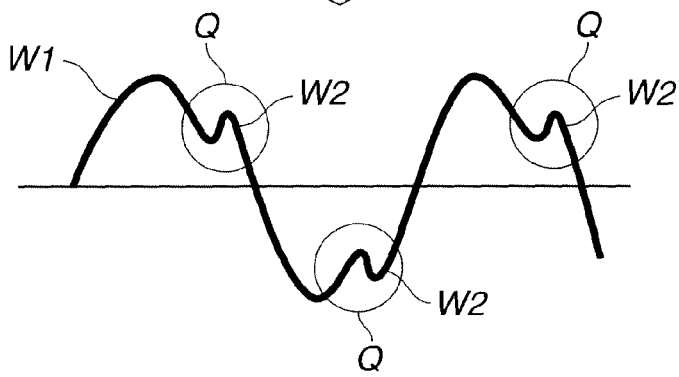

Upon passage of the intake sound through the intake sound generation apparatus 4, the vibration member 5 is vibrated not only in the axial direction as indicated by the arrow M1 but also in the radial direction as indicated by the arrow M2, owing to the offset arrangement of the introduction duct 6 and the resonance duct 7 relative to the vibration member 5. Specifically, the vibration in the axial direction M1 has a sinusoidal waveform W1 as shown in FIG. 4A. In contrast, the total vibration in both the axial direction M1 and the radial direction M2 has a composite waveform of the sinusoidal waveform W1 and a waveform W2 overlapped with or superimposed on the sinusoidal waveform W1 as indicated at a circled part Q shown in FIG. 4B. For this reason, a band of the intake sound produced by the vibration of the vibration member 5 becomes wide to be more widened through the resonance duct 7. As a result, the intake sound with an increased band is emitted to the outside through the intake sound generation apparatus 4 as compared to that of the conventional intake sound generation apparatus.

Figure 5:
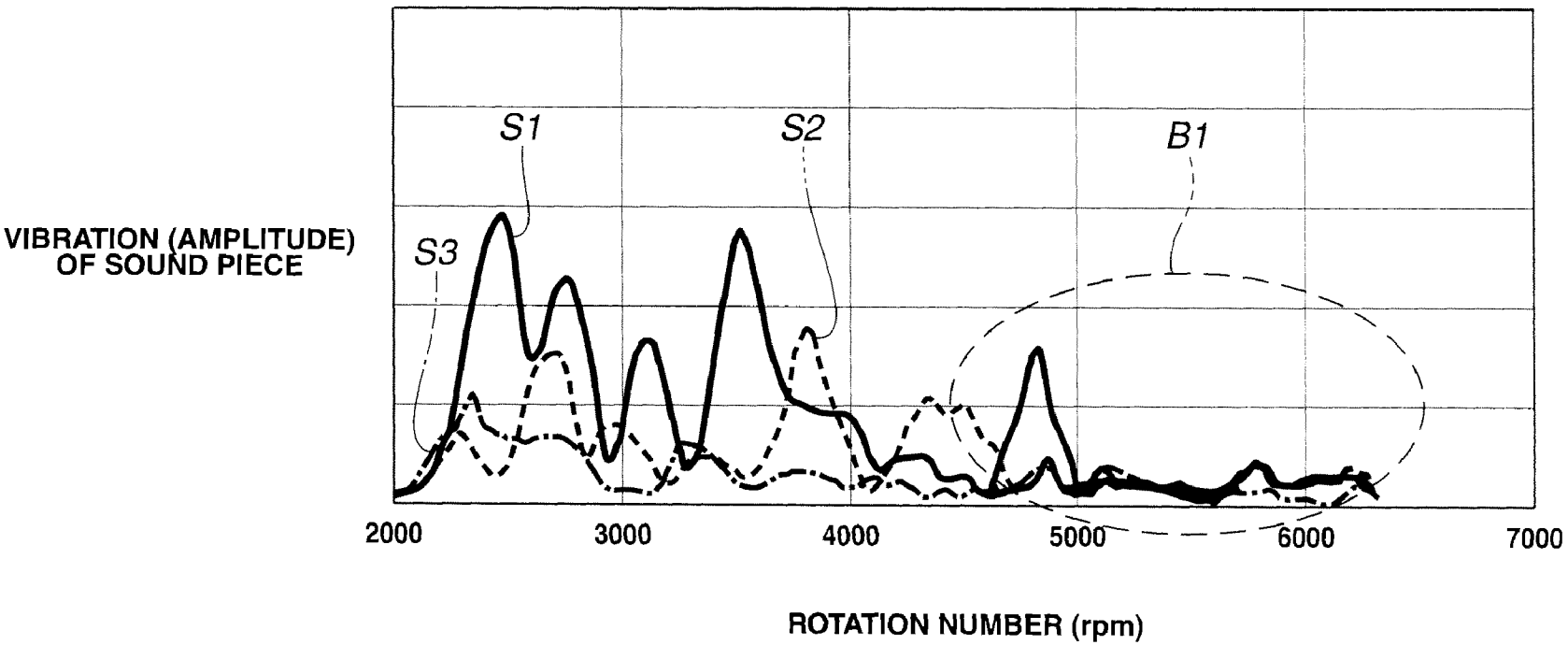
FIG. 5 is a vibration characteristic diagram showing a band of vibration which is generated in the intake sound generation apparatus according to the embodiment in a case where neither an introduction duct nor a resonance duct is offset relative to a vibration member in the intake sound generation apparatus according to the embodiment.
Figure 6:
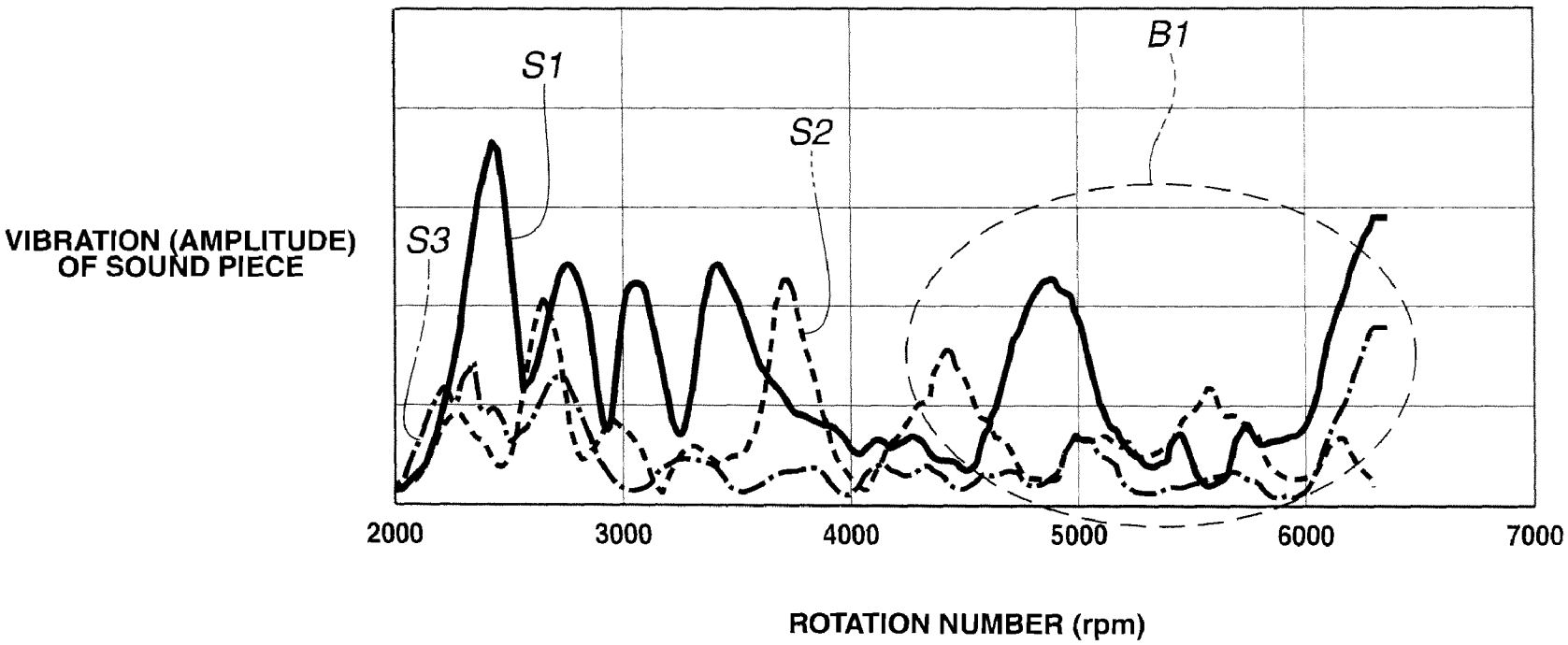
FIG. 6 is a vibration characteristic diagram showing a band of vibration which is generated in a case where the introduction duct and the resonance duct are respectively offset relative to the vibration member in the intake sound generation apparatus according to the embodiment.

FIG. 5 and FIG. 6 are diagrams showing relationships between engine rotation number and amplitude (i.e., vibration level) of vibration of the vibration member (i.e., sound piece) 5 which are different in measuring conditions from each other. That is, FIG. 5 shows the relationship in a case where the offset amount α of the introduction duct 6 relative to the vibration member 5 and the offset amount β of the resonance duct 7 relative to the vibration member 5 are not set, and FIG. 6 shows the relationship in a case where the offset amount α of the introduction duct 6 relative to the vibration member 5 and the offset amount β of the resonance duct 7 relative to the vibration member 5 are set similar to the above embodiment. Meanwhile, there is present an interrelation between engine rotation number and frequency of the intake sound in which as the engine rotation number becomes larger, the frequency becomes higher. In FIG. 5 and FIG. 6, solid line S1 indicates a fundamental order vibration component, broken line S2 indicates a (fundamental order−0.5 order) vibration component, and dot-dash line S3 indicates a (fundamental order+0.5 order) vibration component. The fundamental order of vibration is defined on the basis of the number of cylinders of the engine 2 as described above.

As apparently shown in FIG. 5, in the case where the offset amount α of the introduction duct 6 relative to the vibration member 5 and the offset amount β of the resonance duct 7 relative to the vibration member 5 are not set, amplitudes of the vibration components S1, S2 and S3 are rapidly damped in a high rotation range B1 of 5000 rpm or more of the engine rotation number, respectively. In contrast, as shown in FIG. 6, in the case where the offset amount α of the introduction duct 6 relative to the vibration member 5 and the offset amount β of the resonance duct 7 relative to the vibration member 5 are set, amplitudes of the vibration components S1, S2 and S3 become larger than those as shown in FIG. 5 in all rotation ranges of the engine rotation number, respectively. In particular, as shown in FIG. 6, the amplitudes of the vibration components S1, S2 and S3 are remarkably large without being damped in the high rotation range B1 of 5000 rpm or more of the engine rotation number, respectively. As recognized from FIG. 6, a resonance effect of the vibration member 5 can be attained over a wide range covering from a low rotation speed to middle and high rotation speeds of the engine 2, in other words, over a wide frequency band range covering from a low frequency band to a high frequency band. A sound wave (acoustic wave) or an intake sound which is generated by the vibration of the vibration member 5 in the wide frequency band is amplified due to the columnar resonance of the resonance duct 7, and then emitted from the opening 7*a* of the resonance duct 7. Accordingly, a distinctive intake sound with an additional sound quality can be produced as a powerful sound effect in a wider band than that in the conventional art.

Further, in FIG. 2, in view of a relationship between the vibration member 5 and the introduction duct 6 arranged offset (eccentric) relative to the vibration member 5, and a relationship between the vibration member 5 and the resonance duct 7 arranged offset (eccentric) relative to the vibration member 5, both the constructions can be regarded as a Helmholtz resonator whose resonance chamber is formed by the vibration member 5 or the chamber 8 which has an inside space. A resonance frequency of the Helmholtz resonator is defined by the following expression (3).

$$f = \frac{C}{2\pi}\sqrt{\frac{\pi r^2}{V(L + r\sigma)}} \tag{3}$$

wherein f denotes a resonance frequency, C denotes a sonic speed, r denotes a radius of a duct, V denotes a volume of a resonance chamber, L denotes a length of the duct, and σ denotes an open end correction value at an open end of the duct.

Since the introduction duct 6 and the resonance duct 7 are arranged offset relative to the vibration member 5 and the chamber 8 as shown in FIG. 2, a part of a circumferential wall of the introduction duct 6 which is positioned on the side toward which the central axis C1 of the introduction duct 6 is offset relative to the common central axis C3 of the vibration member 5 and the chamber 8 (i.e., on the upper side as shown in FIG. 2) is located closer to a part of the cylindrical side wall of the vibration member 5 and a part of a circumferential wall of the chamber 8 which are positioned on the same side. Similarly, a part of a circumferential wall of the resonance duct 7 which is positioned on the side toward which the central axis C2 of the resonance duct 7 is offset relative to the common central axis C3 of the vibration member 5 and the chamber 8 (i.e., on the lower side as shown in FIG. 2) is located closer to a part of the cylindrical side wall of the vibration member 5 and a part of the circumferential wall of the chamber 8 which are located on the same side. As a result, a sound effect of the introduction duct 6 and the resonance duct 7 is interfered by the circumferential wall of the vibration member 5 and the circumferential wall of the chamber 8.

Figure 7:
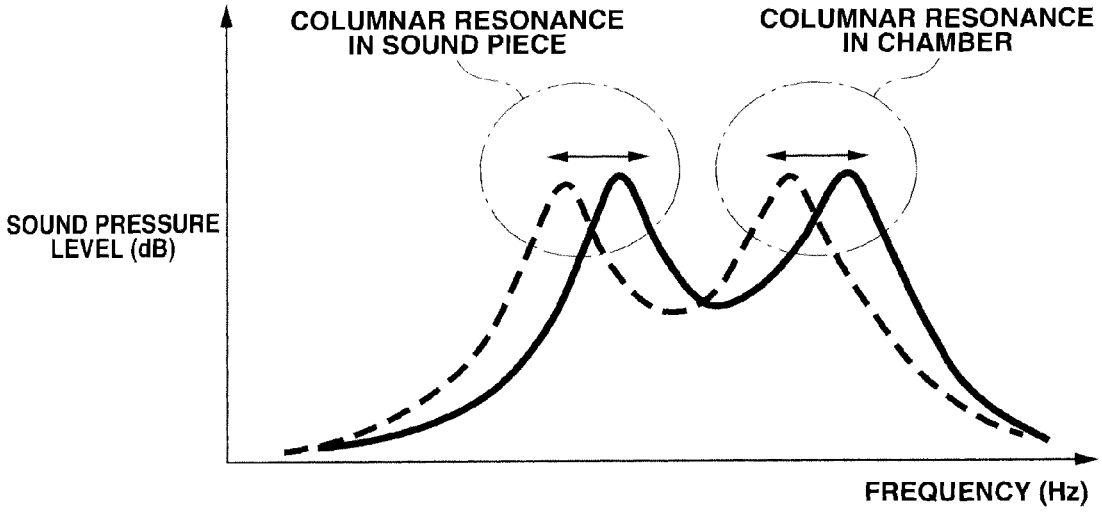
FIG. 7 is a frequency characteristic diagram which is obtained assuming that the intake sound generation apparatus shown in FIG. 2 is a Helmholtz resonator.

According to the above expression (3), the so-called open end correction value σ with respect to the respective columnar resonance in the introduction duct 6 and the resonance duct 7 is influenced by the interference, so that the resonance frequency in the respective columnar resonance is varied. FIG. 7 shows a characteristic curve of the resonance frequency as indicated by chain line which is obtained in a case where the offset amount α of the introduction duct 6 relative to the vibration member (i.e., sound piece) 5 and the offset amount β of the resonance duct 7 relative to the vibration member (i.e., sound piece) 5 are not set, and a characteristic curve of the resonance frequency as indicated by solid line which is obtained in a case where the offset amount α of the introduction duct 6 relative to the vibration member 5 and the offset amount β of the resonance duct 7 relative to the vibration member 5 are set. As shown in FIG. 7, the characteristic curve of the resonance frequency obtained when the offset amounts α, β are set is offset toward the high-frequency side with respect to the characteristic curve of the resonance frequency obtained when the offset amounts α, β are not set. Accordingly, by suitably adjusting the offset amount α of the introduction duct 6 and the offset amount β of the resonance duct 7, it is possible to positively control the resonance frequency in the respective columnar resonance, and therefore, positively tune the sound level of the intake sound emitted from the resonance duct 7.

Figure 8:
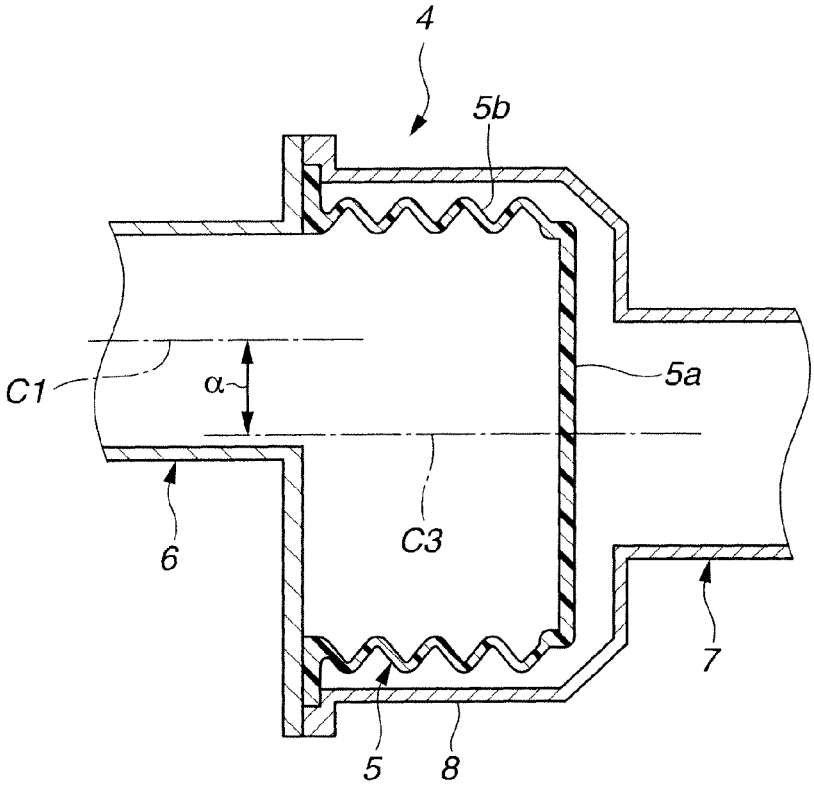
FIG. 8 is a sectional view of an essential part of a modification of the intake sound generation apparatus shown in FIG. 2 in which only the introduction duct is offset relative to the vibration member.

The intake sound generation apparatus of the present invention is not limited to the intake sound generation apparatus according to the embodiment as shown in FIG. 2 in which both the central axis C1 of the introduction duct 6 and the central axis C2 of the resonance duct 7 are located offset relative to the common central axis C3 of the vibration member 5 and the chamber 8. FIG. 8 shows a modification of the embodiment shown in FIG. 2 in which only the introduction duct 6 is arranged offset relative to the vibration member 5 and the chamber 8. As shown in FIG. 8, the central axis C1 of the introduction duct 6 is offset relative to the common central axis C3 of the vibration member 5 and the chamber 8 by the offset amount α, but the central axis C2 of the resonance duct 7 is not offset relative to the common central axis C3.

Figure 9:
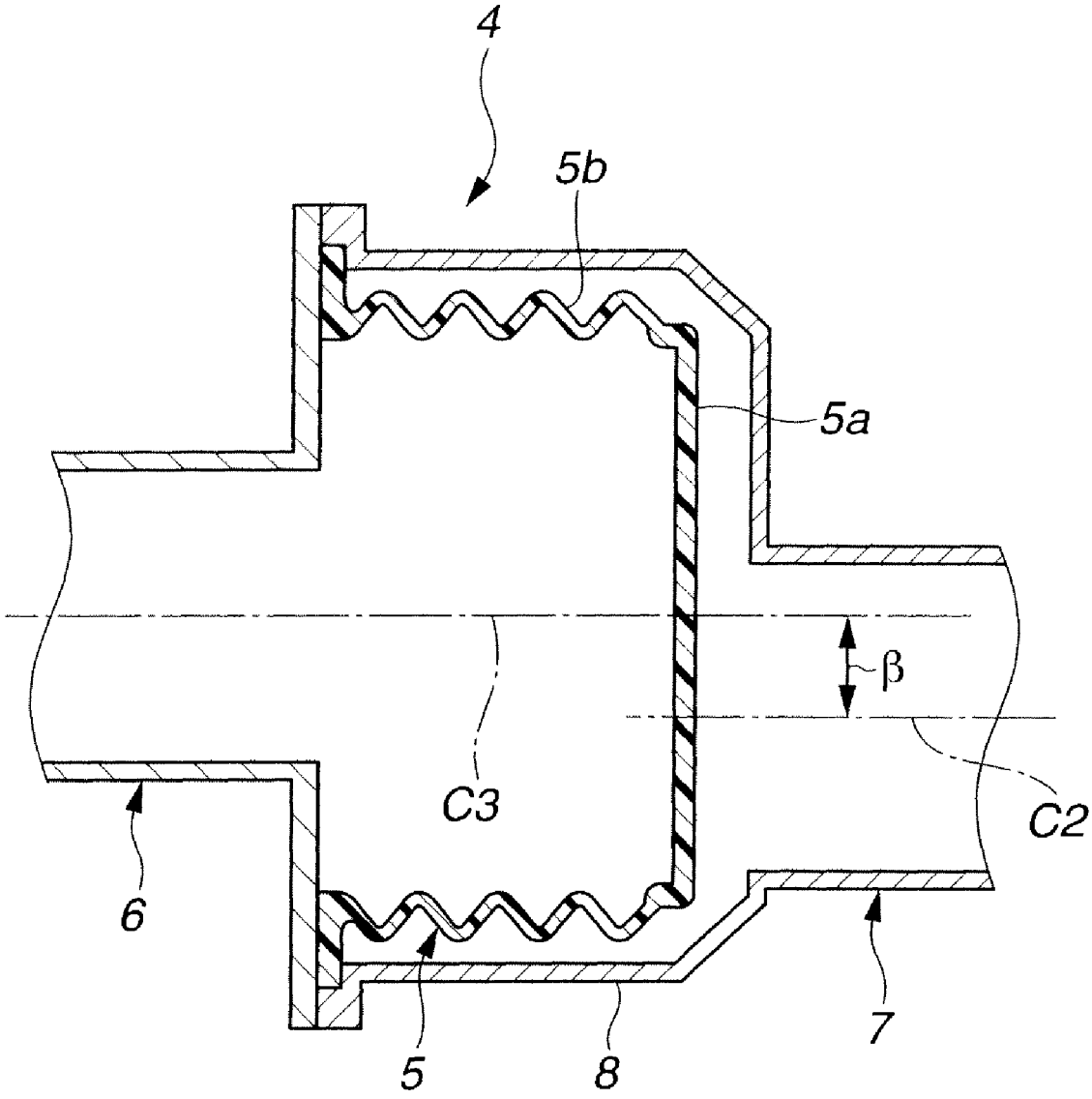
FIG. 9 is a sectional view of an essential part of a modification of the intake sound generation apparatus shown in FIG. 2 in which only the resonance duct is offset relative to the vibration member.

FIG. 9 shows another modification of the embodiment shown in FIG. 2 in which only the resonance duct 7 is arranged offset relative to the vibration member 5 and the chamber 8. As shown in FIG. 9, the central axis C2 of the resonance duct 7 is located offset relative to the common central axis C3 of the vibration member 5 and the chamber 8 by the offset amount β, but the central axis C1 of the introduction duct 6 is not offset relative to the common central axis C3.

The intake sound generation apparatus according to the embodiment and the modifications as described above can attain the following effects. The intake sound which is generated as a sound effect with a given sound quality added due to the resonance in the intake sound generation apparatus can be produced in a wider frequency band. Accordingly, the effect of providing a sound quality of the intake sound can be further enhanced. Further, a resonance frequency of the columnar resonance can be changed by adjusting the offset amount of the introduction duct and/or the resonance duct relative to the vibration member and the chamber. Therefore, it is possible to readily perform tuning of a target frequency of the intake sound to be produced as a sound effect. Furthermore, since the offset arrangement of at least one of the introduction duct and the resonance duct relative to the vibration member and the chamber is a precondition of the intake sound generation apparatus of the present invention, a freedom of layout of the intake sound generation apparatus even in the narrow engine compartment can be increased to thereby readily avoid interference with other parts disposed in the engine compartment.

This application is based on a prior Japanese Patent Application No. 2010-142217 filed on Jun. 23, 2010. The entire contents of the Japanese Patent Application No. 2010-142217 are hereby incorporated by reference.

Although the invention has been described above by reference to a certain embodiment of the invention and modifications thereof, the invention is not limited to the embodiment and the modifications as described above. Variations of the embodiment and the modifications as described above will occur to those skilled in the art in light of the above teachings. The scope of the invention is defined with reference to the following claims.

What is claimed is:

1. An intake sound generation apparatus for an internal combustion engine, the internal combustion engine including an intake system including an intake passage, the intake sound generation apparatus comprising:

an introduction duct connected to the intake passage and introducing intake pulsation in the intake system thereinto;

a vibration member including a diaphragm portion which is vibrated by the intake pulsation, and a bellows portion configured to promote vibration of the diaphragm portion, the vibration member being so disposed as to cover one end of the introduction duct, and a resonance duct having one end connected to the introduction duct through the vibration member and the other end opened to an outside of the intake sound generation apparatus, the resonance duct acting to increase and emit a sound pressure of intake sound produced by vibration of the vibration member, wherein a central axis of the introduction duct and a central axis of the resonance duct are located offset in directions opposite to each other, and both the central axis of the introduction duct and the central axis of the resonance duct are located offset to a central axis of the vibration member.

2. The intake sound generation apparatus as claimed in claim 1, wherein an offset amount of the central axis of at least one of the introduction duct and the resonance duct with respect to the central axis of the vibration member is set in a range of 7% to 40% of a diameter of the vibration member.

3. The intake sound generation apparatus as claimed in claim 2, wherein the vibration member has a generally cylindrical shape with a closed end, the diaphragm portion is formed by a bottom wall of the vibration member and the bellows portion is formed by a cylindrical side wall of the vibration member.

4. The intake sound generation apparatus as claimed in claim 3, further comprising a chamber which accommodates the vibration member, wherein the chamber has a diameter larger than a diameter of the introduction duct and a diameter of the resonance duct, and the introduction duct and the resonance duct are connected to opposite sides of the chamber in an axial direction of the chamber.

5. The intake sound generation apparatus as claimed in claim 4, wherein the chamber is disposed concentrically with the vibration member.

6. The intake sound generation apparatus as claimed in claim 4, wherein the diaphragm portion and the bellows portion of the vibration member are disposed without contact with the chamber.

7. The intake sound generation apparatus as claimed in claim 4, wherein the chamber is formed integrally with the resonance duct.

8. The intake sound generation apparatus as claimed in claim 4, wherein the vibration member is fixedly held between the introduction duct and the chamber.

* * * * *